US012503915B2

(12) United States Patent
Zhu et al.

(10) Patent No.: US 12,503,915 B2
(45) Date of Patent: Dec. 23, 2025

(54) VALVE-CONTROLLED HIGH-ENERGY HYDROSTATIC DOWN-THE-HOLE IMPACT HAMMER

(71) Applicant: Southwest petroleum university, Chengdu (CN)

(72) Inventors: Xiaohua Zhu, Chengdu (CN); Weiji Liu, Chengdu (CN); Yaojie Cheng, Chengdu (CN)

(73) Assignee: SOUTHWEST PETROLEUM UNIVERSITY, Chengdu (CN)

( * ) Notice: Subject to any disclaimer, the term of this patent is extended or adjusted under 35 U.S.C. 154(b) by 185 days.

(21) Appl. No.: 18/600,875

(22) Filed: Mar. 11, 2024

(65) Prior Publication Data

US 2024/0337157 A1 Oct. 10, 2024

(30) Foreign Application Priority Data

Apr. 6, 2023 (CN) ..... 202310356366.1

(51) Int. Cl.
*E21B 4/14* (2006.01)
*E21B 1/26* (2006.01)
*E21B 1/38* (2006.01)

(52) U.S. Cl.
CPC . *E21B 1/38* (2020.05); *E21B 1/26* (2020.05)

(58) Field of Classification Search
None
See application file for complete search history.

(56) References Cited

U.S. PATENT DOCUMENTS 3,503,459 A * 3/1970 Schindler ..... E21B 4/14 173/136
5,014,796 A * 5/1991 Gustafsson ..... E21B 4/14 173/78
5,715,897 A * 2/1998 Gustafsson ..... E21B 4/14 173/17
2004/0188146 A1* 9/2004 Egerstrom ..... E21B 4/14 175/296
2020/0347678 A1* 11/2020 Välisalo ..... E21B 4/14
2020/0370373 A1* 11/2020 Aros ..... E21B 10/38

* cited by examiner

*Primary Examiner* — Kipp C Wallace
(74) *Attorney, Agent, or Firm* — Zhigang Ma

(57) ABSTRACT

A valve-controlled high-energy hydrostatic down-the-hole (DTH) impact hammer is provided, including an upper joint, a shell, a drainage device, an upper fixed valve sleeve, a lower fixed valve sleeve, a main valve, a piston hammer, a supporting sleeve, a sealing piston, a guiding sleeve, a stop ring, a fixing casing pipe, and a drilling bit. The impact hammer is internally defined with a first chamber, a second chamber, a third chamber and a pressure relief chamber. The first chamber is responsible for providing drilling fluid to move the piston hammer up and down by realizing the pressure change of the drilling fluid in the second and third chambers through the holes and flow channels in the upper and lower fixed valve sleeves. The impact hammer transfers the main pressure relief mode from the axis of the impact hammer to the pressure relief chamber between the supporting sleeve and the shell.

11 Claims, 9 Drawing Sheets

VALVE-CONTROLLED HIGH-ENERGY HYDROSTATIC DOWN-THE-HOLE IMPACT HAMMER

TECHNICAL FIELD

The disclosure relates to the field of hot dry rock (HDR), hard formation mining and oil and gas drilling, and more particularly to a valve-controlled high-energy hydrostatic down-the-hole (DTH) impact hammer.

BACKGROUND

With the development of exploration and development of oil and natural gas resources in China, the complex geological characteristics, such as harder rock formation, deep buried oil and gas, and high formation temperature and pressure, are becoming more and more obvious. There is an urgent need for oil drilling, HDR, and hard formation mining to greatly improve the drilling rate and effectively reduce the drilling cost.

It is difficult to meet the current requirements of improving drilling rate by developing new drilling bits and optimizing drilling parameters in a conventional manner. Hydraulic rotary-percussion drilling technology is one of the effective technical means to solve the problem of low mechanical drilling rate in hard formations. The hydraulic rotary-percussion drilling technology is a combination of percussive drilling and rotary drilling. Its working principle is to install a special impactor on a specific drilling bit, the impactor applies a certain frequency impact load to the drilling bit on the basis of dual effects of weight on bit (WOB, also referred to as drilling pressure) and torque, and drilling is carried out under combined effects of impact crushing and rotary scraping. Rotary-percussion drilling has the advantages of improving drilling efficiency and WOB transmission efficiency in hard rock formations. In addition, this technology also has the function of preventing well deviation, especially for strata with formation dip angle, which can ensure good wellbore quality. However, the impact energy of the current hydraulic impactor is not high, there is still a lot of room for improvement, and the impact frequency is also low. Therefore, it is urgent to develop a hydraulic impactor with high frequency and large impact power to meet the needs of oil and gas drilling, HDR and hard formation mining at present.

The disclosure relies on the static pressure of drilling fluid to push a piston hammer to impact the drilling bit to do work. Compared with the related art based on traditional dynamic pressure, the pressure drop of the impactor is high and the drilling efficiency is greatly improved. The disclosure also transfers a main pressure relief flow channel from an axis of the impactor to a pressure relief chamber located between a supporting sleeve and a shell, so that most of the space at the axis of the impactor is reserved for the piston hammer, so as to improve the quality of the piston hammer, further improve the impact power of the impactor, and carry out efficient rock breaking.

SUMMARY

A purpose of the disclosure is to provide a valve-controlled high-energy hydrostatic DTH impact hammer (also referred to impactor), which can not only improve the quality of a piston hammer, but also use the static pressure of drilling fluid to push the piston hammer to accelerate downward impact on a drilling bit, so as to improve the final impact speed of the piston hammer. Both ways can greatly improve the impact power of the piston hammer, carry out efficient rock breaking and improve drilling efficiency.

In order to achieve the above purpose, technical solutions adopted by the disclosure are as follows.

Specifically, a valve-controlled high-energy hydrostatic down-the-hole impact hammer includes an upper joint, a shell, a drainage device, a guiding sleeve, a stop ring, a fixing casing pipe, and a drilling bit. The drainage device is defined with drainage holes. The guiding sleeve is configured (i.e., structured and arranged) to guide the drilling bit to move along an axial direction. The stop ring is configured to limit displacement of the drilling bit along the axial direction. The fixing casing pipe is internally provided with a spline to limit a circumferential rotation of the drilling bit. The upper joint and the fixing casing pipe are in a threaded connection with the shell. The valve-controlled hydrostatic DTH impact hammer further includes an upper fixed valve sleeve, a lower fixed valve sleeve, a main valve, a piston hammer, a supporting sleeve, and a sealing piston. An inner space of the valve-controlled hydrostatic DTH impact hammer is divided into a first chamber and a third chamber by the drainage device, the upper fixed valve sleeve, the lower fixed valve sleeve, the piston hammer and the sealing piston. The lower fixed valve sleeve is defined with a circular groove therein, and the circular groove and an upper surface of the piston hammer define a second chamber. The upper joint, the shell, the upper fixed valve sleeve, the lower fixed valve sleeve, the supporting sleeve, and the sealing piston define a pressure relief chamber. The upper fixed valve sleeve is defined with first pressurized holes and first pressure relief holes. The main valve is defined with second pressurized holes and second pressure relief holes. When the main valve moves up and down, the first pressurized holes and the second pressurized holes are intermittently connected, and the first pressure relief holes and the second pressure relief holes are intermittently connected. The sealing piston is defined with third pressure relief holes. The drilling bit is defined with a through first pressure relief flow channel, and the first pressure relief holes and the pressure relief chamber are connected to the third pressure relief holes. The upper fixed valve sleeve and the lower fixed valve sleeve together define a control chamber. The lower fixed valve sleeve is defined with a through pressurized flow channel, constant flow channels connected to the first chamber and the third chamber, and control flow channels connected to the control chamber and the third chamber. When the main valve moves up and down, the pressurized flow channel is intermittently connected to the first chamber and the second chamber. The lower fixed valve sleeve is defined with control holes respectively connected to the control flow channels. The piston hammer is defined with fourth pressure relief holes and a second pressure relief flow channel. When the piston hammer moves up and down, the control holes and the fourth pressure relief holes are intermittently connected. The second pressure relief flow channel is connected to the first pressure relief flow channel.

An inner side of the shell is provided with a fixed step part. The sealing piston is tightly pressed on the fixed step part by the supporting sleeve. The upper fixed valve sleeve is tightly pressed on the lower fixed valve sleeve. The drainage device and the supporting sleeve are respectively fixed with the upper fixed valve sleeve and the lower fixed valve sleeve.

In an embodiment, the main valve is provided with a first step surface and a second step surface; and an area of the second step surface is 2-3 times that of the first step surface.

In an embodiment, the upper fixed valve sleeve is defined with five fan-shaped through holes respectively connected to the constant flow channels of the lower fixed valve sleeve. The upper fixed valve sleeve is provided with five first convex platforms below. Each of the five first convex platforms is internally defined with a first groove with a same shape as the convex platform. An upper of the lower fixed valve sleeve is defined with second grooves. The first convex platforms are respectively matched with the second grooves. The first grooves of the first convex platforms are respectively connected to the control flow channels of the lower fixed valve sleeve. The upper fixed valve sleeve is defined with grooves to make the first pressurized holes be matched with the second pressurized holes and the first pressure relief holes be matched with the second pressure relief holes.

In an embodiment, a sealing ring is arranged between the upper fixed valve sleeve and the upper joint to prevent a drilling fluid in the first chamber from leaking into the pressure relief chamber.

In an embodiment, an upper end face of the lower fixed valve sleeve is provided with a first positioning step part. The first positioning step part is coaxial with the main valve to make the main valve move along the axial direction. A lower end face of the lower fixed valve sleeve is provided with a second positioning step part to match with the supporting sleeve.

In an embodiment, a circumference of the supporting sleeve is provided with reinforcing ribs to increase a strength of the supporting sleeve, and the reinforcing ribs abut against the shell.

In an embodiment, a sealing ring is arranged between the supporting sleeve and the lower fixed valve sleeve to prevent a drilling fluid in the third chamber from leaking into the pressure relief chamber.

In an embodiment, the piston hammer is defined with a third groove and a fourth groove. The third groove is configured to be connected to the control holes and the fourth pressure relief holes, and the fourth groove is configured to be connected to the control flow channels and the third chamber.

In an embodiment, the piston hammer is provided with a third step surface below, and the third step surface is configured to provide pressure for accelerating upward movement of the piston hammer.

In an embodiment, the sealing piston is defined with a fifth groove, and the fifth groove is matched with the supporting sleeve.

Compared with that a hydraulic impactor in the related art, the disclosure has the characteristics and advantages as follows.

The disclosure provides the valve-controlled high-energy hydrostatic DTH impact hammer, which controls the up-and-down movement of the main valve and the impact movement of the piston hammer through the static pressure of water. The impact hammer can also greatly increase the mass of the piston hammer and the final velocity when the piston hammer hits the drilling bit, so as to improve the impact power of the impact hammer, and finally achieve efficient rock breaking and improve drilling efficiency.

DESCRIPTION OF REFERENCE SIGNS

1. upper joint; 2. first chamber; 3. shell; 31. fixed step part; 4. upper fixed valve sleeve; 41. first pressurized hole; 42. first pressure relief hole; 43. fan-shaped through hole; 44. first convex platform; 45. first groove; 46. groove; 47. sealing ring; 5. control chamber; 6. pressure relief chamber; 7. lower fixed valve sleeve; 71. pressurized flow channel; 72. constant flow channel; 73. control flow channel; 74. control hole; 75. circular groove; 76. second groove; 77. first positioning step part; 78. second positioning step part; 8. supporting sleeve; 81. sealing ring; 82. reinforcing rib; 9. sealing piston; 91. third pressure relief hole; 92. fifth groove; 10. guiding sleeve; 11. stop ring; 12. fixing casing pipe; 121. spline; 13. drilling bit; 14. drainage device; 141. drainage hole; 15. main valve; 151. second pressurized hole; 152. second pressure relief hole; 153. first step surface; 154. second step surface; 16. second chamber; 17. piston hammer; 171. third groove; 172. fourth pressure relief hole; 173. fourth groove; 174. second pressure relief flow channel; 175. third step surface; 18. third chamber.

DETAILED DESCRIPTION OF EMBODIMENTS

In order to make purposes, technical solutions, and advantages of the disclosure clearer, the disclosure will be further described with the accompanying drawings. In the description of the disclosure, it should be understood that the azimuth or positional relationships indicated by the terms "upper", "lower", "front", "rear", "top", "inner", and "outer" are based on the azimuth or positional relationship shown in the accompanying drawings only for the purpose of facilitating the description of the disclosure and simplifying the description, and does not indicate or imply that devices or elements referred to must have a specific azimuth or a specific orientation.

Specifically, a valve-controlled high-energy hydrostatic DTH impact hammer according to some embodiments of the disclosure will be described below with reference to the accompanying drawings.

Figure 1:
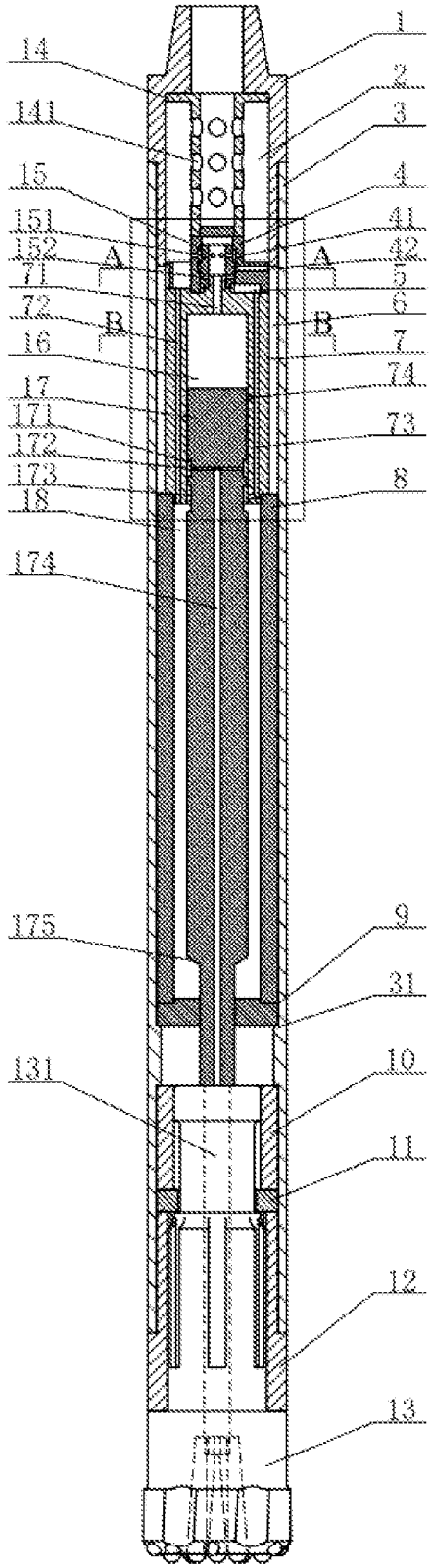
FIG. 1 illustrates a schematic structural view of a valve-controlled high-energy hydrostatic DTH impact hammer in an initial state of the disclosure.
Figure 2:
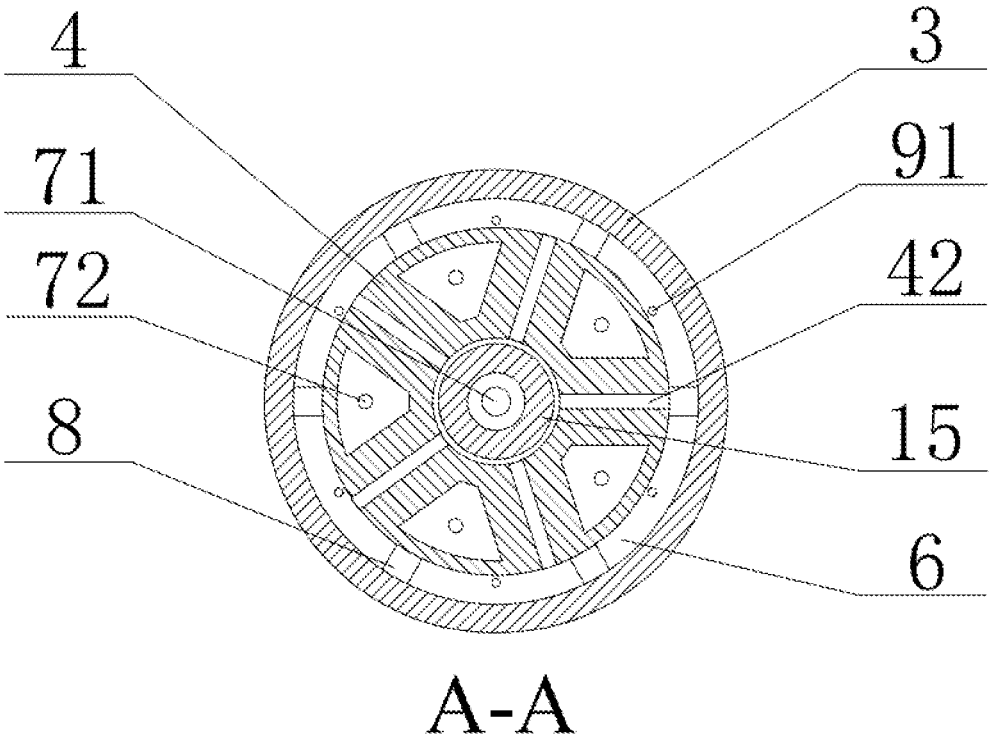
FIG. 2 illustrates a cross-sectional view taken along line A-A of FIG. 1 of the disclosure.
Figure 3:
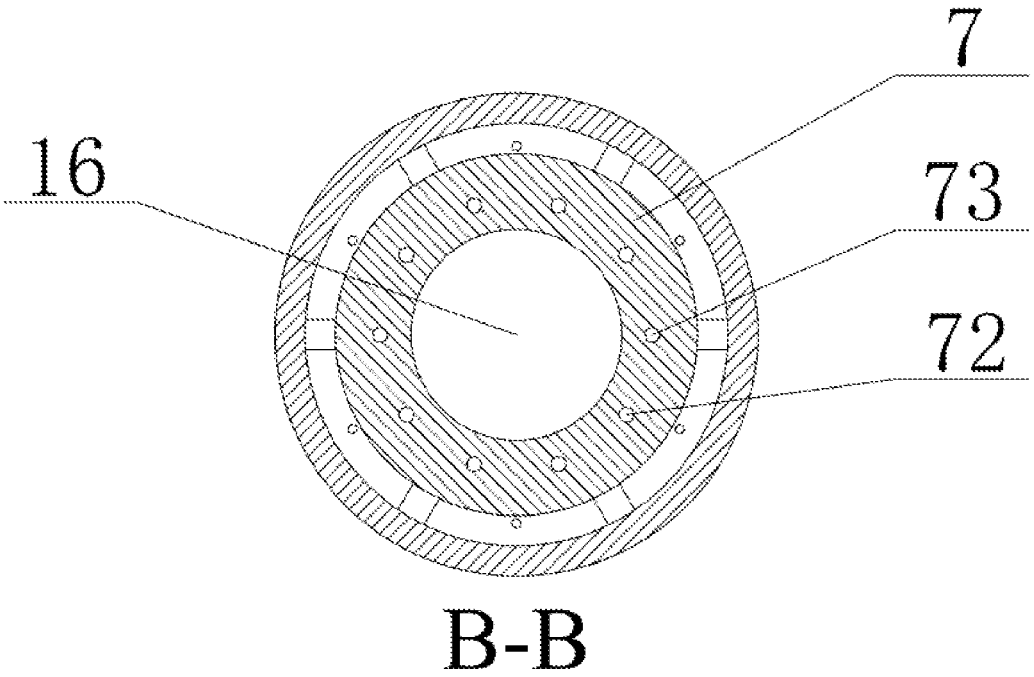
FIG. 3 illustrates a cross-sectional view taken along line B-B of FIG. 1 according to the disclosure.
Figure 4:
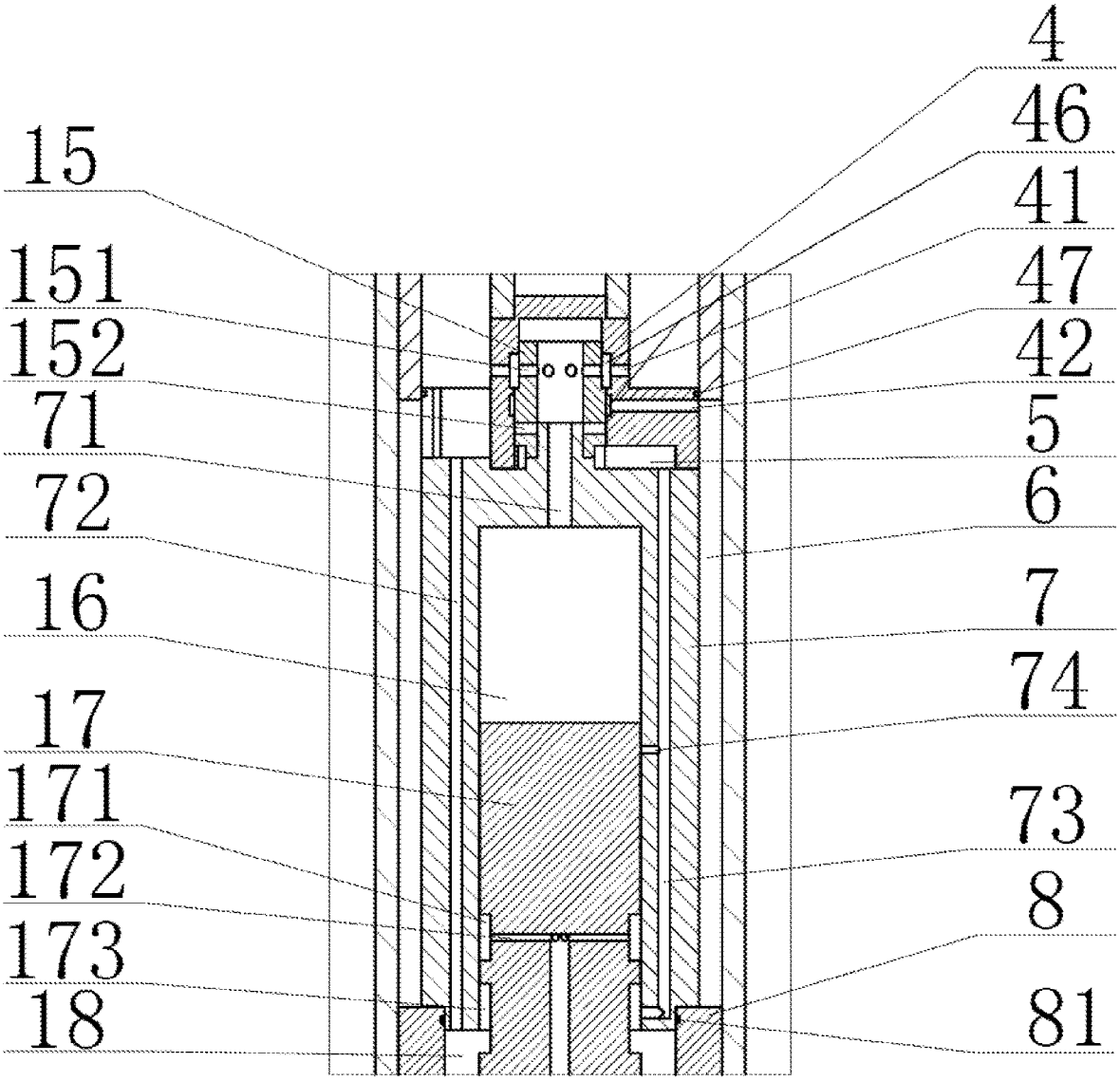
FIG. 4 illustrates a partial enlarged view of FIG. 1 of the disclosure.
Figure 5:
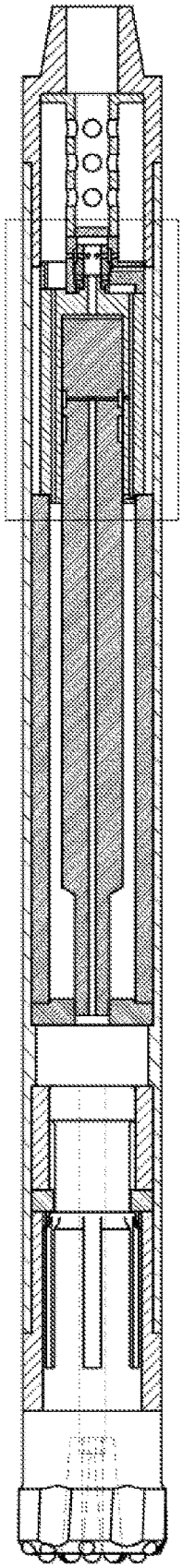
FIG. 5 illustrates a schematic structural view of the valve-controlled high-energy hydrostatic DTH impact hammer when a piston hammer is at an upper dead point of the disclosure.
Figure 6:
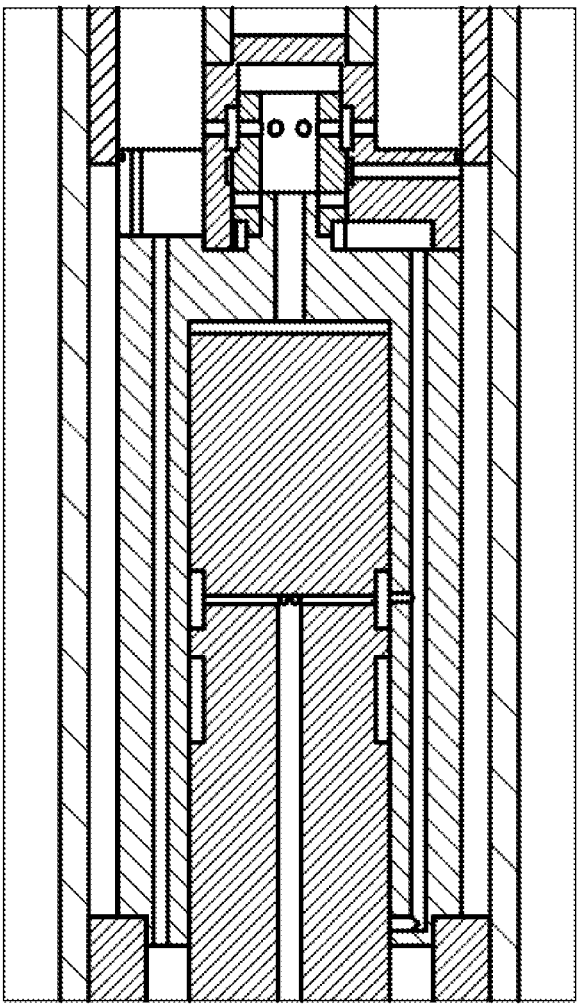
FIG. 6 illustrates a partial enlarged view of FIG. 5 of the disclosure.
Figure 11A:
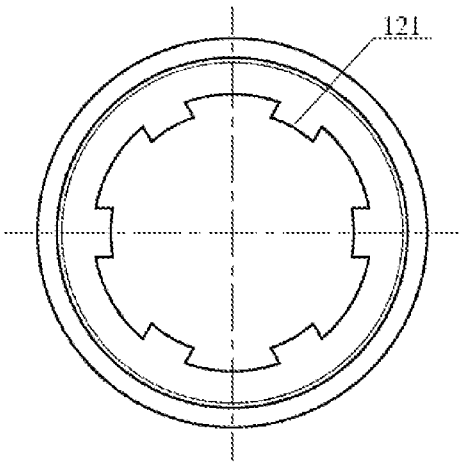
FIGS. 11A-11B illustrate schematic structural views of a fixing casing pipe of the disclosure.
Figure 11B:
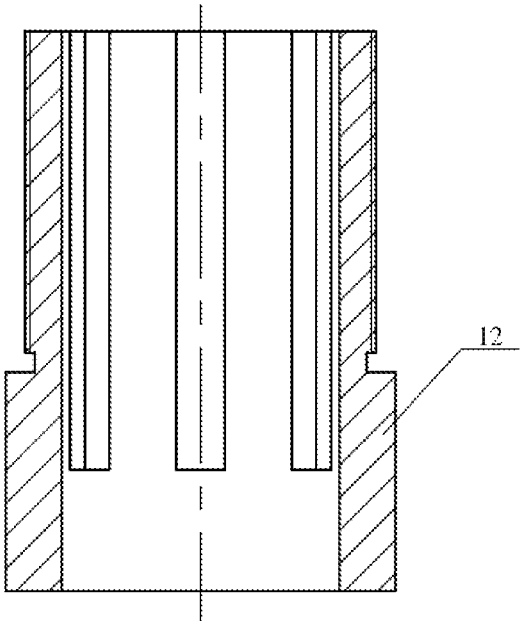

The disclosure mainly aims at the valve-controlled high-energy hydrostatic DTH impact hammer, as shown in FIG. 1 and FIGS. 11A-11B, which includes an upper joint 1, a shell 3, a drainage device 14, a guiding sleeve 10, a stop ring 11, a fixing casing pipe 12, and a drilling bit 13. The drainage device 14 is defined with drainage holes 141. The guiding sleeve 10 is configured to guide the drilling bit 13 to move along an axial direction. The stop ring 11 is configured to limit displacement of the drilling bit 13 along the axial direction. The fixing casing pipe 12 is internally provided with a spline 121 to limit a circumferential rotation of the drilling bit 13. The upper joint 1 and the fixing casing pipe 12 are in a threaded connection with the shell 3. The impact hammer further includes an upper fixed valve sleeve 4, a lower fixed valve sleeve 7, a main valve 15, a piston hammer 17, a supporting sleeve 8, and a sealing piston 9. An inner space of the impact hammer is divided into a first chamber 2 and a third chamber 18 by the drainage device 14, the upper fixed valve sleeve 4, the lower fixed valve sleeve 7, the piston hammer 17, and the sealing piston 9. The lower fixed valve sleeve 7 is defined with a circular groove 75 therein, and the circular groove 75 and an upper surface of the piston hammer 17 define a second chamber 16. The upper joint 1, the shell 3, the upper fixed valve sleeve 4, the lower fixed valve sleeve 7, the supporting sleeve 8, and the sealing piston 9 define a pressure relief chamber 6. The upper fixed valve sleeve 4 is defined with first pressurized holes 41 and first pressure relief holes 42. The main valve 15 is defined with second pressurized holes 151 and second pressure relief holes 152. When the main valve 15 moves up and down, the first pressurized holes 41 and the second pressurized holes 151 are intermittently connected, and the first pressure relief holes 42 and the second pressure relief holes 152 are intermittently connected. The sealing piston 9 is defined with a third pressure relief hole 91. The drilling bit 13 is defined with a through first pressure relief flow channel 131, and the first pressure relief holes 42 and the pressure relief chamber 6 are connected to the third pressure relief holes 91. The upper fixed valve sleeve 4 and the lower fixed valve sleeve 7 together define a control chamber 5. The lower fixed valve sleeve 7 is defined with a through pressurized flow channel 71, constant flow channels 72 connected to the first chamber 2 and the third chamber 18, and control flow channels 73 connected to the control chamber 5 and the third chamber 18. When the main valve 15 moves up and down, the pressurized flow channel 71 is intermittently connected to the first chamber 2 and the second chamber 16. The lower fixed valve sleeve 7 is defined with control holes 74 respectively connected to the control flow channels 73. The piston hammer 17 is defined with fourth pressure relief holes 172 and a second pressure relief flow channel 174. When the piston hammer 17 moves up and down, the control holes 74 and the fourth pressure relief holes 172 are intermittently connected. The second pressure relief flow channel 174 is connected to the first pressure relief flow channel 131.

An inner side of the shell 3 is provided with a fixed step part 31. The sealing piston 9 is tightly pressed on the fixed step part 31 by the supporting sleeve 8. The upper fixed valve sleeve 4 is tightly pressed on the lower fixed valve sleeve 7. The drainage device 14 and the supporting sleeve 8 are respectively fixed with the upper fixed valve sleeve 4 and the lower fixed valve sleeve 7.

Figure 8A:
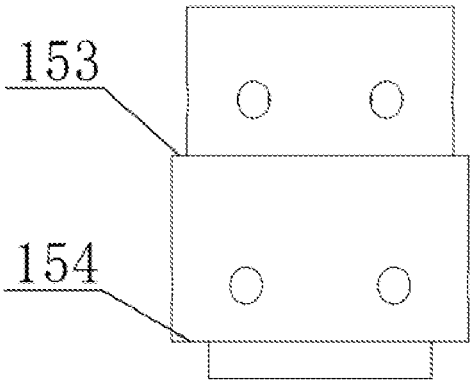
FIGS. 8A-8B illustrate schematic structural views of a main valve of the disclosure.
Figure 8B:
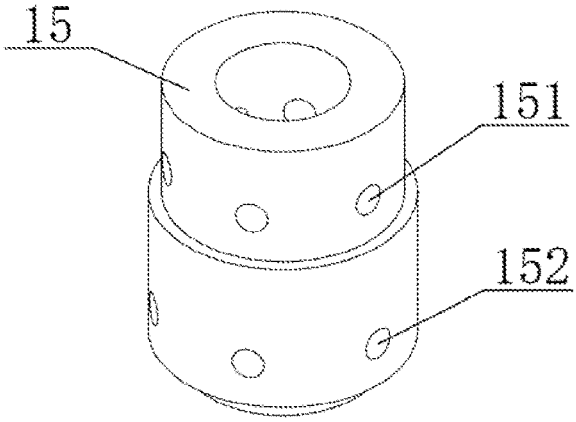

In an embodiment, as shown in FIGS. 8A-8B, the main valve 15 is provided with a first step surface 153 and a second step surface 154. An area of the second step surface 154 is 2-3 times that of the first step surface 153.

Figure 7A:
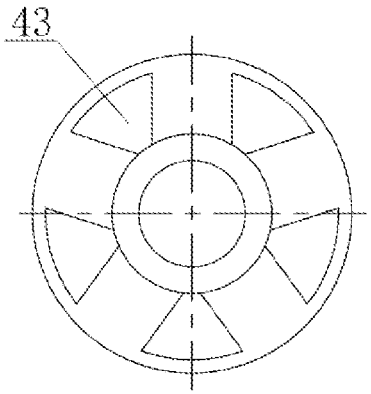
FIGS. 7A-7C illustrate schematic structural views of an upper fixed valve sleeve of the disclosure.
Figure 7B:
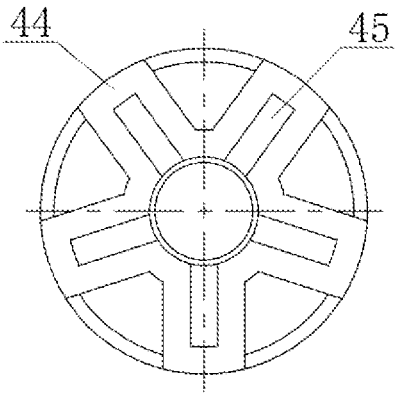
Figure 7C:
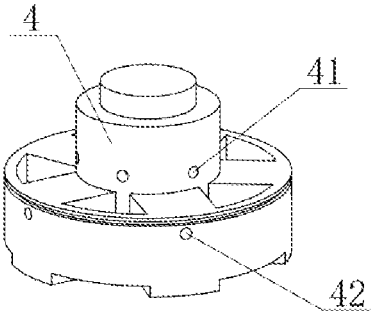

In an embodiment, as shown in FIGS. 7A-7C, the upper fixed valve sleeve 4 is provided with five fan-shaped through holes 43 respectively connected to the constant flow channels 72 of the lower fixed valve sleeve 7. The upper fixed valve sleeve 4 is provided with five first convex platforms 44 below. Each of each of the five first convex platforms 44 is internally defined with a first groove 45 with a same shape as the convex platform. An upper of the lower fixed valve sleeve 7 is defined with second grooves 76. The first convex platforms 44 are respectively matched with the second grooves 76. The first grooves 45 of the first convex platforms 44 are respectively connected to the control flow channels 73 of the lower fixed valve sleeve 7. The upper fixed valve sleeve 4 is defined with grooves 46 to make the first pressurized holes 41 be matched with the second pressurized holes 151 and the first pressure relief holes 42 be matched with the second pressure relief holes 152.

In an embodiment, a sealing ring 47 is arranged between the upper fixed valve sleeve 4 and the upper joint 1 to prevent a high-pressure drilling fluid in the first chamber 2 from leaking into the pressure relief chamber 6.

Figure 9A:
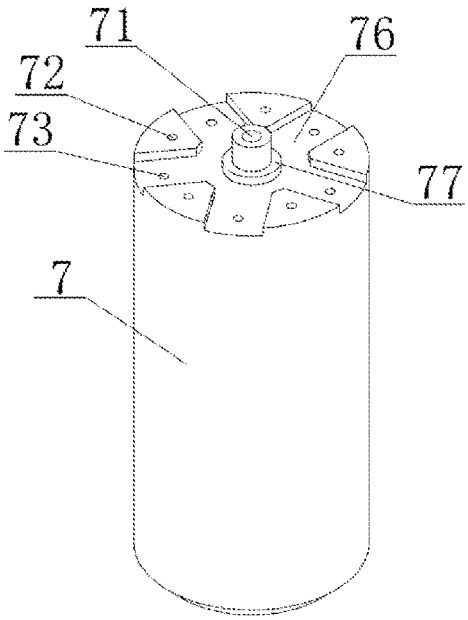
FIGS. 9A-9B illustrate schematic structural views of a lower fixed valve sleeve of the disclosure.
Figure 9B:
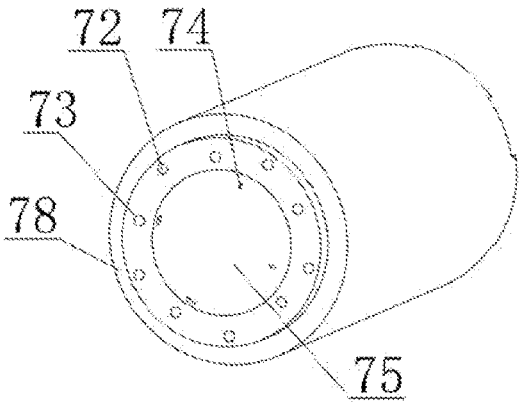

In an embodiment, as shown in FIGS. 9A-9B, an upper end face of the lower fixed valve sleeve 7 is provided with a first positioning step part 77. The first positioning step part 77 is coaxial with the main valve 15 to make the main valve 15 move along the axial direction. A lower end face of the lower fixed valve sleeve 7 is provided with a second positioning step part 78 to match with the supporting sleeve 8.

Figure 12:
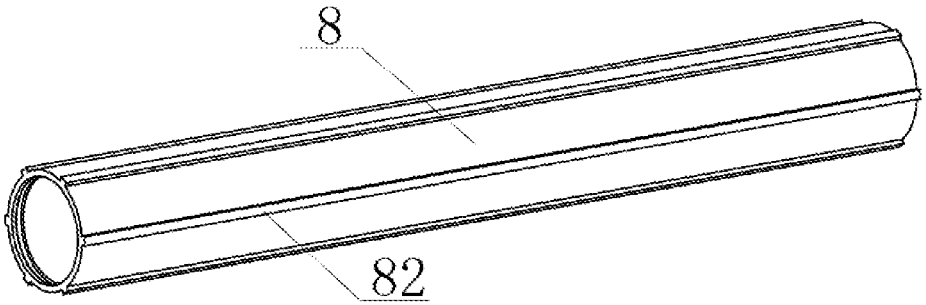
FIG. 12 illustrates a schematic structural view of a supporting sleeve of the disclosure.

In an embodiment, as shown in FIG. 12, a circumference of the supporting sleeve 8 is provided with reinforcing ribs 82 to increase a strength of the supporting sleeve 8. The reinforcing ribs 82 abut against the shell 3.

In an embodiment, a sealing ring 81 is arranged between the supporting sleeve 8 and the lower fixed valve sleeve 7 to prevent the high-pressure drilling fluid in the third chamber 18 from leaking into the pressure relief chamber 6.

In an embodiment, the piston hammer 17 is defined with a third groove 171 and a fourth groove 173. The third groove 171 is used to be connected to the control holes 74 and the fourth pressure relief holes 172. The fourth groove 173 is used to be connected to the control flow channels 73 and the third chamber 18.

In an embodiment, the piston hammer 17 is provided with a third step surface 175 below. The third step surface 175 is used to provide pressure for accelerating upward movement of the piston hammer 17.

Figure 10:
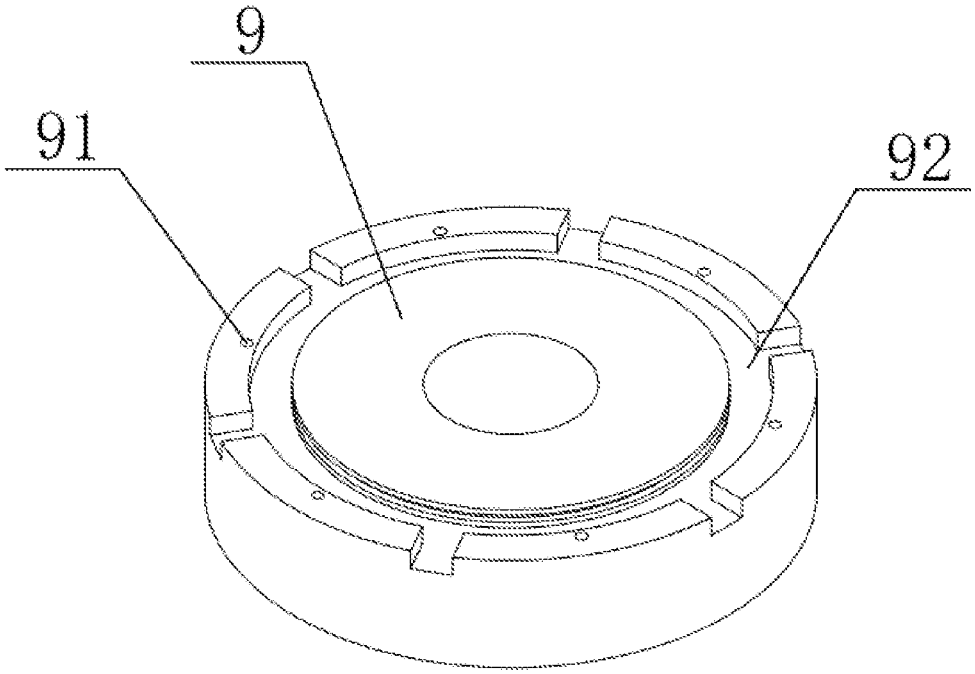
FIG. 10 illustrates a schematic structural view of a sealing piston of the disclosure.

In an embodiment, as shown in FIG. 10, the sealing piston 9 is defined with a fifth groove 92, and the fifth groove 92 is matched with the supporting sleeve 8.

A working process of the disclosure in drilling operation is as follows.

The disclosure relates to the valve-controlled high-energy hydrostatic DTH impact hammer. In the initial state, the lower end face of the main valve 15 is in contact with the first positioning step part 77 of the upper end face of the lower fixed valve sleeve 7 under the action of gravity, and the lower end face of the piston hammer 17 is in contact with the upper end face of the drilling bit 13 under the action of gravity. At this time, the first pressurized holes 41 in the upper fixed valve sleeve 4 are respectively connected to the second pressurized holes 151 in the main valve 15, and the first pressure relief holes 42 in the upper fixed valve sleeve 4 are not connected to the second pressure relief holes 152 in the main valve 15. Due to the blocking of the piston hammer 17, the control holes 74 in the control flow channel 73 are not connected to the fourth pressure relief holes 172 in the piston hammer 17. At this time, the first chamber 2 is connected to the second chamber 16 through the first pressurized holes 41, the second pressurized holes 151 and the pressurized flow channel 71, and the third chamber 18 is connected to the control chamber 5 through the control flow channels 73. High-pressure drilling fluid enters from the upper joint 1 and enters the first chamber 2 through the drainage holes 141 on the drainage device 14, part of the high-pressure drilling fluid enters the pressurized flow channel 71 through the first pressurized holes 41 on the upper fixed valve sleeve 4 and the second pressurized holes 151 on the main valve 15, and the part of the high-pressure drilling fluid enters the second chamber 16 through the pressurized flow channel 71; and part of the high-pressure drilling fluid enters the third chamber 18 through the constant flow channels 72 on the lower fixed valve sleeve 7 and enters the control chamber 5 through the control flow channels 73. At this time, the first chamber 2, the second chamber 16, the third chamber 18, and the control flow channels 73 are all filled with high-pressure drilling fluid and constantly pressurized, because the area of the upper end surface of the piston hammer 17 is much larger than that of the lower third step surface 175, and the piston hammer 17 remains stationary at this time. The area of the second step surface 154 on the main valve 15 is 2-3 times that of the first step surface 153. The main valve 15 moves upward for a certain distance under the pressure difference, so that the second pressure relief holes 152 on the main valve 15 are respectively connected to the first pressure relief holes 42 on the upper fixed valve sleeve 4, and the second pressurized holes 151 on the main valve 15 are not connected to the first pressure relief holes 41 on the upper fixed valve sleeve 4. The high-pressure drilling fluid in the second chamber 16 is connected to the pressure relief chamber 6 through the pressurized flow channel 71, the second pressure relief holes 152 in the main valve 15 and the first pressure relief holes 42 in the upper fixed valve sleeve 4, and then is connected to the third pressure relief holes 91 in the sealing piston 9. When the piston hammer 17 goes up, it is connected to the first pressure relief flow channel 131 and then is connected to the outside. At this time, the second chamber 16 is in a low-pressure state, and the high-pressure drilling fluid of the third chamber 18 acts on the third step surface 175 of the outer surface of the piston hammer 17, causing the piston hammer 17 to accelerate upward.

After the piston hammer 17 accelerates upward for a certain distance, it will block the connection between the control flow channels 73 and the third chamber 18. At this time, both the control flow channels 73 and the control chamber 5 are filled with high-pressure drilling fluid to keep the main valve 15 still. The high-pressure drilling fluid in the third chamber 18 continues to act on the third step surface 175 on the outer surface of the piston hammer 17, so that the piston hammer 17 continues to accelerate upward. When the piston hammer 17 continues to ascend for a certain distance, the third groove 171 on the outer surface of the piston hammer 17 makes the control holes 74 on the control flow channel 73 be connected to the fourth pressure relief holes 172 on the piston hammer 17, the high-pressure drilling fluid in the control chamber 5 is connected to the fourth pressure relief holes 172 through the control holes 74 on the control flow channel 73, enters the second pressure relief flow channel 174, and then is connected to the outside, so that the control chamber 5 is in a low-pressure state. The first step surface 153 on the main valve 15 is subjected to the pressure of high-pressure drilling fluid, so that the main valve 15 moves downward for a certain distance under the pressure difference, so that the first pressurized holes 41 on the upper fixed valve sleeve 4 are connected to the second pressurized holes 151 on the main valve 15, and the first pressure relief holes 42 on the upper fixed valve sleeve 4 are not connected to the second pressure relief holes 152 on the main valve 15. At this time, part of the high-pressure drilling fluid in the first chamber 2 continues to pass through the first pressurized holes 41 in the upper fixed valve sleeve 4 and the second pressurized holes 151 in the main valve 15, enters the pressurized flow channel 71, and then enters the second chamber 16 through the pressurized flow channel 71 to pressurize the second chamber 16, so that the piston hammer 17 enters the upward deceleration stage.

When the piston hammer 17 runs to the upper dead point, under the action of the high-pressure drilling fluid in the second chamber 16, the piston hammer 17 starts to accelerate downward and hit the drilling bit 13. After the piston hammer 17 moves downward for a certain distance, the piston hammer 17 blocks the connection between the control holes 74 connected to the control flow channel 73 and the fourth pressure relief holes 172 in the piston hammer 17. Just before the piston hammer 17 hits the drilling bit 13, the control flow channels 73 are connected to the third chamber 18, and the piston hammer 17 hits the drilling bit 13 due to inertia. The high-pressure drilling fluid in the third chamber 18 enters the control chamber 5 through the control flow channels 73, and the main valve 15 moves upward for a certain distance under the action of the upper and lower pressure difference, so that the second pressure relief holes 152 on the main valve 15 are connected to the first pressure relief holes 42 on the upper fixed valve sleeve 4, and the second pressure relief holes 151 on the main valve 15 are not connected to the first pressure relief holes 41 on the upper fixed valve sleeve 4. The high-pressure drilling fluid in the second chamber 16 is connected to the pressure relief chamber 6 through the pressurized flow channel 71, the second pressure relief holes 152 on the main valve 15 and the first pressure relief holes 42 on the upper fixed valve sleeve 4, and then is connected to the third pressure relief holes 91 in the sealing piston 9. When the piston hammer 17 goes up, the high-pressure drilling fluid is connected to the first pressure relief flow channel 131 and then connected to the outside. At this time, the second chamber 16 is in a low-pressure state, and the high-pressure drilling fluid of the third chamber 18 acts on the third step surface 175 of the outer surface of the piston hammer 17 to accelerate the piston hammer 17 in the reverse direction, so reciprocating.

The basic principle, main features and advantages of the disclosure have been shown and described above. The above is only the illustrated embodiments of the disclosure and is not intended to limit the disclosure in any form. Although the disclosure has been disclosed in the illustrated embodiment, but not for the purpose of limiting the disclosure, any skilled in the art can make some changes or modifications into an equivalent embodiment of equivalent changes by using the technical content disclosed above without departing from the technical content of the disclosure. Any simple modifications, equivalent changes and modifications made to the above embodiments according to the technical essence of the disclosure without departing from the content of the technical solution of the disclosure still fall within the scope of the technical solution of the disclosure.

What is claimed is:

1. A valve-controlled hydrostatic down-the-hole (DTH) impact hammer, comprising: an upper joint (1), a shell (3), a drainage device (14), a guiding sleeve (10), a stop ring (11), a fixing casing pipe (12), and a drilling bit (13);

wherein the drainage device (14) is defined with drainage holes (141); the guiding sleeve (10) is configured to guide the drilling bit (13) to move along an axial direction; the stop ring (11) is configured to limit displacement of the drilling bit (13) along the axial direction; the fixing casing pipe (12) is internally provided with a spline (121) to limit a circumferential rotation of the drilling bit (13); and the upper joint (1) and the fixing casing pipe (12) are in a threaded connection with the shell (3);

the valve-controlled hydrostatic DTH impact hammer further comprises an upper fixed valve sleeve (4), a lower fixed valve sleeve (7), a main valve (15), a piston hammer (17), a supporting sleeve (8) and a sealing piston (9);

an inner space of the valve-controlled hydrostatic DTH impact hammer is divided into a first chamber (2) and a third chamber (18) by the drainage device (14), the upper fixed valve sleeve (4), the lower fixed valve sleeve (7), the piston hammer (17) and the sealing piston (9); the lower fixed valve sleeve (7) is defined with a bore (75) therein; the bore (75) and an upper surface of the piston hammer (17) define a second chamber (16); the upper joint (1), the shell (3), the upper fixed valve sleeve (4), the lower fixed valve sleeve (7), the supporting sleeve (8) and the sealing piston (9) define a pressure relief chamber (6); and the upper fixed valve sleeve (4) is defined with first pressurized holes (41) and first pressure relief holes (42);

the main valve (15) is defined with second pressurized holes (151) and second pressure relief holes (152); when the main valve (15) moves up and down, the first pressurized holes (41) and the second pressurized holes (151) are intermittently connected, and the first pressure relief holes (42) and the second pressure relief holes (152) are intermittently connected;

the sealing piston (9) is defined with third pressure relief holes (91); the drilling bit (13) is defined with a through first pressure relief flow channel (131); the first pressure relief holes (42) and the pressure relief chamber (6) are connected to the third pressure relief holes (91);

the upper fixed valve sleeve (4) and the lower fixed valve sleeve (7) together define a control chamber (5); the lower fixed valve sleeve (7) is defined with a through pressurized flow channel (71), constant flow channels (72) connected to the first chamber (2) and the third chamber (18), and control flow channels (73) connected to the control chamber (5) and the third chamber (18);

when the main valve (15) moves up and down, the pressurized flow channel (71) is intermittently connected to the first chamber (2) and the second chamber (16); the lower fixed valve sleeve (7) is defined with control holes (74) respectively connected to the control flow channels (73); the piston hammer (17) is defined with fourth pressure relief holes (172) and a second pressure relief flow channel (174); when the piston hammer (17) moves up and down, the control holes (74) and the fourth pressure relief holes (172) are intermittently connected; and the second pressure relief flow channel (174) is connected to the first pressure relief flow channel (131); and an inner side of the shell (3) is provided with a fixed step part (31); the sealing piston (9) is tightly pressed on the fixed step part (31) by the supporting sleeve (8); the upper fixed valve sleeve (4) is tightly pressed on the lower fixed valve sleeve (7); and the drainage device (14) and the supporting sleeve (8) are respectively fixed with the upper fixed valve sleeve (4) and the lower fixed valve sleeve (7).

2. The valve-controlled hydrostatic DTH impact hammer according to claim 1, wherein the main valve (15) is provided with a first step surface (153) and a second step surface (154); and an area of the second step surface (154) is 2-3 times that of the first step surface (153).

3. The valve-controlled hydrostatic DTH impact hammer according to claim 1, wherein the upper fixed valve sleeve (4) is defined with five fan-shaped through holes (43) respectively connected to the constant flow channels (72) of the lower fixed valve sleeve (7); the upper fixed valve sleeve (4) is provided with five first convex platforms (44) below; each of the five first convex platforms (44) is internally defined with a first groove (45); an upper of the lower fixed valve sleeve (7) is defined with second grooves (76); the first convex platforms (44) are respectively matched with the second grooves (76); the first grooves (45) of the first convex platforms (44) are respectively connected to the control flow channels (73) of the lower fixed valve sleeve (7); the upper fixed valve sleeve (4) is defined with grooves (46) to make the first pressurized holes (41) be matched with the second pressurized holes (151) and the first pressure relief holes (42) be matched with the second pressure relief holes (152).

4. The valve-controlled hydrostatic DTH impact hammer according to claim 3, wherein a sealing ring (47) is arranged between the upper fixed valve sleeve (4) and the upper joint (1) to prevent a drilling fluid in the first chamber (2) from leaking into the pressure relief chamber (6).

5. The valve-controlled hydrostatic DTH impact hammer according to claim 1, wherein an upper end face of the lower fixed valve sleeve (7) is provided with a first positioning step part (77); the first positioning step part (77) is coaxial with the main valve (15) to make the main valve (15) move along the axial direction; and a lower end face of the lower fixed valve sleeve (7) is provided with a second positioning step part (78) to match with the supporting sleeve (8).

6. The valve-controlled hydrostatic DTH impact hammer according to claim 1, wherein a circumference of the supporting sleeve (8) is provided with reinforcing ribs (82) to increase a strength of the supporting sleeve (8); and the reinforcing ribs (82) abut against the shell (3).

7. The valve-controlled hydrostatic DTH impact hammer according to claim 6, wherein a sealing ring (81) is arranged between the supporting sleeve (8) and the lower fixed valve sleeve (7) to prevent a drilling fluid in the third chamber (18) from leaking into the pressure relief chamber (6).

8. The valve-controlled hydrostatic DTH impact hammer according to claim 1, wherein the piston hammer (17) is defined with a third groove (171) and a fourth groove (173); the third groove (171) is configured to be connected to the control holes (74) and the fourth pressure relief holes (172); and the fourth groove (173) is configured to be connected to the control flow channels (73) and the third chamber (18).

9. The valve-controlled hydrostatic DTH impact hammer according to claim 8, wherein the piston hammer (17) is provided with a third step surface (175) below; and the third step surface (175) is configured to provide pressure for accelerating upward movement of the piston hammer (17).

10. The valve-controlled hydrostatic DTH impact hammer according to claim 1, wherein the sealing piston (9) is defined with a fifth groove (92); and the fifth groove (92) is matched with the supporting sleeve (8).

11. A DTH impact hammer, comprising:

a shell (3);

an upper joint (1), connected to an end of the shell (3);

a fixing casing pipe (12), connected to an end of the shell (3) facing away from the upper joint (1);

a drilling bit (13), disposed on a side of the fixing casing pipe (12) facing away from the shell (3) and defined with a first pressure relief flow channel (131);

a drainage device (14), disposed in the upper joint (1); wherein atop of the drainage device (14) abuts against an inside of the upper joint (1) and the drainage device (14) is defined with drainage holes (141);

an upper fixed valve sleeve (4), disposed in the shell (3) and arranged on a bottom of the drainage device (14); wherein the upper fixed valve sleeve (4) is defined with first pressurized holes (41) and first pressure relief holes (42);

a main valve (15), disposed in the upper fixed valve sleeve (4) and defined with second pressurized holes (151) matched with the first pressurized holes (41) and second pressure relief holes (152) matched with the first pressure relief holes (42);

a lower fixed valve sleeve (7), disposed in the shell (3) and arranged on a side of the upper fixed valve sleeve (4) facing away from the drainage device (14); wherein the upper fixed valve sleeve (4) and the lower fixed valve sleeve (7) together define a control chamber (5); and the lower fixed valve sleeve (7) is defined with a pressurized flow channel (71), constant flow channels (72), control flow channels (73), control holes (74), and a bore (75); and the control flow channels (73) are respectively connected to the control holes (74), the control holes (74) are connected to the bore (75), and the bore (75) is connected to the pressurized flow channel (71);

a supporting sleeve (8), disposed in the shell (3); wherein a top of the supporting sleeve (8) abuts against the lower valve sleeve (7);

a sealing piston (9), disposed in the shell (3) and arranged on a bottom of the supporting sleeve (8); wherein the sealing piston (9) is defined with third pressure relief holes (91);

a piston hammer (17), arranged in the bore (75) and penetrating through the supporting sleeve (8) and the sealing piston (9); wherein the piston hammer (17) is defined with a third groove (171), fourth pressure relief holes (172), a fourth groove (173) and a second pressure relief flow channel (174); and the fourth pressure relief holes (172) are connected to the third groove (171) and the second pressure relief flow channel (174), and the fourth groove (173) is connected to the control flow channels (73);

wherein the upper joint (1), the drainage device (14) and the upper fixed valve sleeve (4) together define a first chamber (2); the circular groove (75) of the lower fixed valve sleeve (7) and the piston hammer (17) together define a second chamber (16); the lower fixed valve sleeve (7), the supporting sleeve (8), the piston hammer (17) and the sealing piston (9) together define a third chamber (18); and the upper joint (1), the shell (3), the upper fixed valve sleeve (4), the lower fixed valve sleeve (7), the supporting sleeve (8) and the sealing piston (9) together define a pressure relief chamber (6);

wherein the drainage holes (141) are connected to the first chamber (2);

wherein in a first state, the first chamber (2) is connected to the second chamber (16) through the first pressurized holes (41), the second pressurized holes (151) and the pressurized flow channel (71); the first chamber (2) is connected to the third chamber (18) through the constant flow channels (72); and the third chamber (18) is connected to the control chamber (5) through the control flow channels (73);

wherein in a second state, the second chamber (16) is connected to the third pressure relief holes (91) through the pressurized flow channel (71), the second pressure relief holes (152), the first pressure relief holes (42) and the pressure relief chamber (6); and the third pressure relief holes (91) are connected to the first pressure relief flow channel (131); and wherein in a third state, the control chamber (5) is connected to the second pressure relief flow channel (174) through the control flow channels (73), the control holes (74) and the fourth pressure relief holes (172).

* * * * *